US008857939B2

(12) United States Patent
Uchino

(10) Patent No.: US 8,857,939 B2
(45) Date of Patent: Oct. 14, 2014

(54) LIQUID EJECTION APPARATUS, CONTROLLING METHOD THEREOF, AND COMPUTER-READABLE MEDIUM FOR LIQUID EJECTION

(71) Applicant: Shunji Uchino, Nagoya (JP)

(72) Inventor: Shunji Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/849,795

(22) Filed: Mar. 25, 2013

(65) Prior Publication Data

US 2014/0071192 A1 Mar. 13, 2014

(30) Foreign Application Priority Data

Mar. 30, 2012 (JP) ..... 2012-081569

(51) Int. Cl.
*B41J 2/045* (2006.01)

(52) U.S. Cl.
CPC ..... *B41J 2/04581* (2013.01)
USPC ..... 347/14

(58) Field of Classification Search
CPC ... B41J 2/04513; B41J 2/0457; B41J 2/04581
USPC ..... 347/14, 57, 68
See application file for complete search history.

(56) References Cited

U.S. PATENT DOCUMENTS 7,537,300 B2 * 5/2009 Hirota et al. ..... 347/11
2010/0103211 A1 * 4/2010 Miyazaki et al. ..... 347/10

FOREIGN PATENT DOCUMENTS

JP 2000203018 A 7/2000
JP 2007131009 A 5/2007

* cited by examiner

*Primary Examiner* — Alessandro Amari
*Assistant Examiner* — Michael Konczal
(74) *Attorney, Agent, or Firm* — Banner & Witcoff, Ltd.

(57) ABSTRACT

A liquid ejection apparatus comprises a plurality of piezoelectric element units, which can be driven to eject liquid by changing a drive voltage, and a control device. The control device may calculate an accumulated time for each of the piezoelectric element units. The accumulated times may be a time that a respective piezoelectric element unit is in a driven state. The control device may also identify a first piezoelectric element unit having a maximum accumulated time and a second piezoelectric element unit having a minimum accumulated time from among the piezoelectric element units. The control device may reduce the drive voltage applied to one or more of the piezoelectric element units that are not in the driven state to a lower voltage, when the control device determines that the difference between the maximum accumulated time and the minimum accumulated time is less than a predetermined time.

11 Claims, 8 Drawing Sheets

V
28
ZERO
0
VOLTAGE V2

V
28
SMALL DROPLET
0
VOLTAGE V2
GROUND VOLTAGE

V
28
MEDIUM DROPLET
0
VOLTAGE V2
GROUND VOLTAGE

V
28
LARGE DROPLET
0
GROUND VOLTAGE
VOLTAGE V2
DRIVING CYCLE

LIQUID EJECTION APPARATUS, CONTROLLING METHOD THEREOF, AND COMPUTER-READABLE MEDIUM FOR LIQUID EJECTION

CROSS-REFERENCE TO RELATED APPLICATION

This application claims priority from Japanese Patent Application No. 2012-081569 filed on Mar. 30, 2012, which is incorporated herein by reference.

FIELD OF DISCLOSURE

The disclosure herein relates to a liquid ejection apparatus comprising a plurality of piezoelectric element units configured to eject liquid and a control method of the liquid ejection apparatus, and computer-readable media for controlling liquid ejection.

BACKGROUND

A known liquid ejection apparatus, e.g., an inkjet printer, includes an ink ejection head including a plurality of piezoelectric element units. In the inkjet printer, each of the piezoelectric element units of the ink ejection head includes a polarized piezoelectric element. A drive voltage is applied to the piezoelectric elements to drive the piezoelectric elements. Thus, ink is ejected from the ink ejection head onto a recording medium. When the drive voltage is applied to the piezoelectric elements for a long period of time, for example, to print on a large number of recording mediums, the degree of polarization of the piezoelectric elements may be reduced, and the piezoelectric elements may deteriorate. When a printing operation is not performed, an electrical connection between electrodes that sandwich the piezoelectric elements may be disconnected to control reduction of the degree of polarization.

During a printing operation, the drive voltage is continuously applied to the piezoelectric elements even when they are not driven, because the electrical connection between electrodes, which sandwich the piezoelectric elements, is connected. Accordingly, the piezoelectric elements may deteriorate. Exceptional research of the present inventor finds that electrical disconnection, in a printing operation, between the electrodes, which sandwich the piezoelectric elements that are not driven, may reduce deterioration of the piezoelectric elements thereby contributing to longer operating life of the ink ejection head. However, this may lead to differences between the piezoelectric elements with respect to the degree of deterioration. Accordingly, the drive voltage applied to the piezoelectric elements needs to be adjusted based on the degree of their deterioration. If the differences among the piezoelectric elements with respect to the degrees of the deterioration increase, the range of adjustment of the drive voltage may increase. This may lead to breakage of a power circuit for supplying the drive voltage.

For example, print heads are connected to linear regulators in a voltage supply circuit for supplying drive voltage to the print head. The linear regulator is configured to output a drive voltage from an OUT terminal by reducing a main voltage input from an IN terminal. A switching regulator supplies the same main voltage to each linear regulator. To adjust the drive voltage for each print head, a voltage reduction range (regulated width) of each of the linear regulators is controlled. However, if differences of the drive voltage among the print heads, i.e., differences of the voltage reduction range of the linear regulators, increase, the voltage reduction range of the linear regulator corresponding to the minimum drive voltage may increase. Accordingly, a heating amount of the linear regulator corresponding to the minimum drive voltage may become relatively large, and the voltage supply circuit may be damaged.

BRIEF SUMMARY

Aspects of the disclosure relate to a liquid ejection apparatus that may reduce breakage of a voltage supply circuit for supplying a voltage to drive a plurality of piezoelectric element units of the liquid ejection apparatus while controlling or reducing the deterioration of piezoelectric elements of the piezoelectric element units. Aspects of the disclosure also include a control method of this liquid ejection apparatus and a computer readable storage medium storing instructions for controlling this liquid ejection apparatus.

A liquid ejection apparatus disclosed herein may comprise a plurality of piezoelectric element units, a power supply, a plurality of linear regulators, and a control device. The piezoelectric element units may be configured to be driven to eject liquid by changing a drive voltage. The power supply may be configured to output a predetermined main voltage. The plurality of linear regulators may be provided in correspondence with the piezoelectric element units. The linear regulators may be configured to supply drive voltages to the respective piezoelectric element units by reducing the main voltage output from the power supply. The control device may be configured to calculate an accumulated time, for each of the piezoelectric element units. Each accumulated time may be a time that the respective piezoelectric element unit is in a driven state, wherein a piezoelectric element unit is in the driven state when the corresponding driving voltage is not reduced or when liquid is ejected. The control device may also be configured to identify a first piezoelectric element unit having a maximum accumulated time and a second piezoelectric element unit having a minimum accumulated time from among the plurality of piezoelectric element units. The control device may further be configured to determine whether a difference between the maximum accumulated time and the minimum accumulated time is less than a predetermined time. The control device may also be configured to reduce the drive voltage applied to one or more of the piezoelectric element units that are not in the driven state to a lower voltage, when the control device determines that the difference between the maximum accumulated time and minimum accumulated time is less than the predetermined time.

A method disclosed herein may be performed with a liquid ejecting apparatus. A liquid ejection apparatus disclosed herein may comprise a plurality of piezoelectric element units, a power supply, and a plurality of linear regulators. The method may comprise a step of calculating an accumulated time, for each of the piezoelectric element units, that the respective piezoelectric element unit is in a driven state, wherein a piezoelectric element unit is in the driven state when the corresponding driving voltage is not reduced or when liquid is ejected. The method may also comprise a step of identifying a first piezoelectric element unit having a maximum accumulated time and a second piezoelectric element unit having a minimum accumulated time from among the plurality of piezoelectric element units. The method may further comprise a step of determining whether a difference between the maximum accumulated time and the minimum accumulated time is less than a predetermined time. The method may also comprise a step of reducing the drive voltage applied to one or more of the piezoelectric element units that are not in the driven state to a lower voltage, when the control device determines that the difference is less than the predetermined time.

Aspects of the disclosure also include one or more non-transitory, computer-readable media storing computer-readable instructions therein. When executed by at least one processor of a liquid ejecting apparatus, the computer-readable instructions may instruct the liquid ejecting apparatus to execute certain steps. The liquid ejecting apparatus may comprise a plurality of piezoelectric element units, a power supply, and a plurality of linear regulators. The computer-readable instructions may instruct the liquid ejecting apparatus to calculate an accumulated time, for each of the piezoelectric element units, that the respective piezoelectric element unit is in the driven state, wherein a piezoelectric element unit is in the driven state when the corresponding driving voltage is not reduced or when liquid is ejected. The computer-readable instructions may also instruct the liquid ejecting apparatus to identify a first piezoelectric element unit having a maximum accumulated time and a second piezoelectric element unit having a minimum accumulated time from among the plurality of piezoelectric element units. The computer-readable instructions may also instruct the liquid ejecting apparatus to determine whether a difference between the maximum accumulated time and the minimum accumulated time is less than a predetermined time. The computer-readable instructions may instruct the liquid ejecting apparatus to reduce the drive voltage applied to one or more of the piezoelectric element units that are not in the driven state to a lower voltage, when the control device determines that the difference is less than the predetermined time.

Degrees of the deterioration of the piezoelectric elements may increase as the accumulated times that piezoelectric element units are in the driven state increase. In the liquid ejection apparatus and its control method, when the difference between a maximum accumulated time and a minimum accumulated time is less than the predetermined time, the drive voltages applied to all of one or more of the piezoelectric element units that are not in the driven state may be reduced to a lower voltage. Thus, progress in the deterioration of all of one or more of the piezoelectric element units that are not driven may be reduced or controlled. When the difference between the maximum accumulated time and the minimum accumulated time is equal to or greater than the predetermined time, the drive voltage(s) applied to the piezoelectric elements of at least one of the piezoelectric element units that are not in the driven state may be reduced to a lower voltage, so as not to increase the difference. Thus, differences of the deterioration among the piezoelectric element units may be reduced.

BRIEF DESCRIPTION OF THE DRAWINGS

Some features disclosed herein are illustrated by way of example, and not by way of limitation, in the figures of the accompanying drawings.

DETAILED DESCRIPTION

Figure 1:
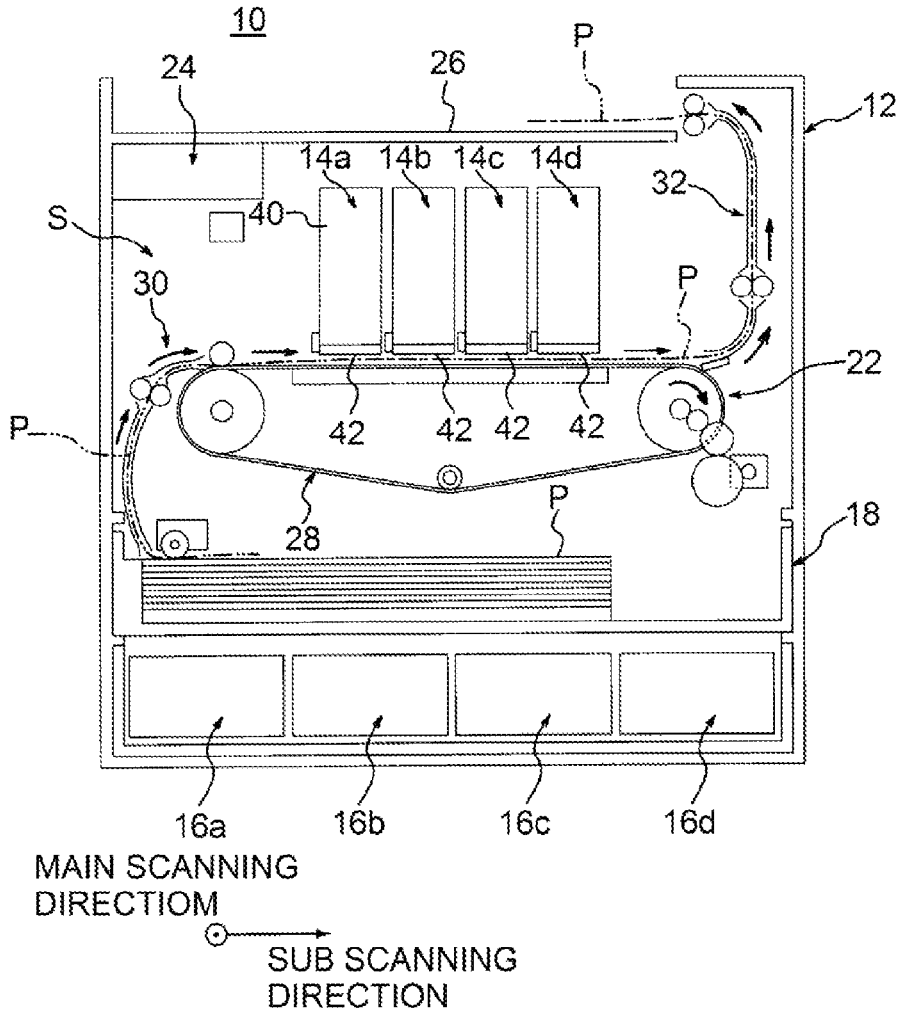
FIG. 1 is a schematic side cross-sectional view of an inkjet printer in an example embodiment according to one or more aspects of the disclosure.

Example embodiments are described in detail herein with reference to the accompanying drawings in which like reference numerals are used for corresponding parts in the various drawings.

As depicted in FIG. 1, a liquid ejection apparatus, e.g., an inkjet printer 10, may comprise a case 12, a plurality of, e.g., four, head units 14*a*-14*d*, each corresponding to one of a plurality of, e.g., four, colors (black, cyan, magenta, yellow) of liquid, e.g., ink, and ink tanks 16*a*-16*d*, each configured to store a different one of the plurality of colors of liquid. The inkjet printer 10 may further comprise a recording medium accommodating portion 18 configured to accommodate recording mediums P (e.g., paper, cloth, film, etc.), a conveying mechanism 22 configured to convey the recording mediums P, and a controlling device 24 configured to perform various controls.

As depicted in FIG. 1, the interior of the case 12 may have a space S which may store various devices and units. An upper surface of the case 12 may be provided with an output portion 26 configured to receive the recording mediums P output by the conveying mechanism 22 outside the case 12. The ink tanks 16*a*-16*d* may be disposed in a lower portion in the space S. The recording medium accommodating portion 18 may be disposed above the ink tanks 16*a*-16*d* in the lower portion of the space S. The head units 14*a*-14*d* and the controlling device 24 may be disposed in an upper portion of the space S. The conveying mechanism 22 may be disposed in central and upper portions of the space S in a vertical direction.

As depicted in FIG. 1, the conveying mechanism 22 may comprise a conveying unit 28, a feeding unit 30, and an output unit 32. The conveying unit 28 may be configured to convey the recording mediums P through a horizontal plane. The feeding unit 30 may be disposed upstream of the conveying unit 28 in a conveying direction of the recording mediums P and configured to feed the recording mediums P accommodated in the recording medium accommodating portion 18 to the conveying unit 28. The output unit 32 may be disposed downstream of the conveying unit 28 in the conveying direction and configured to output the recording mediums P onto the output portion 26. In this embodiment, the conveying direction of the recording mediums P by the conveying unit 28 may be a sub scanning direction. A direction perpendicular to the conveying direction of the recording mediums P and in the horizontal plane may be a main scanning direction. The head units 14*a*-14*d* may be arranged in the sub scanning direction above the conveying unit 28. An area below each of the head units 14*a*-14*d* may be an ejection area where ink may be ejected.

Figure 2:
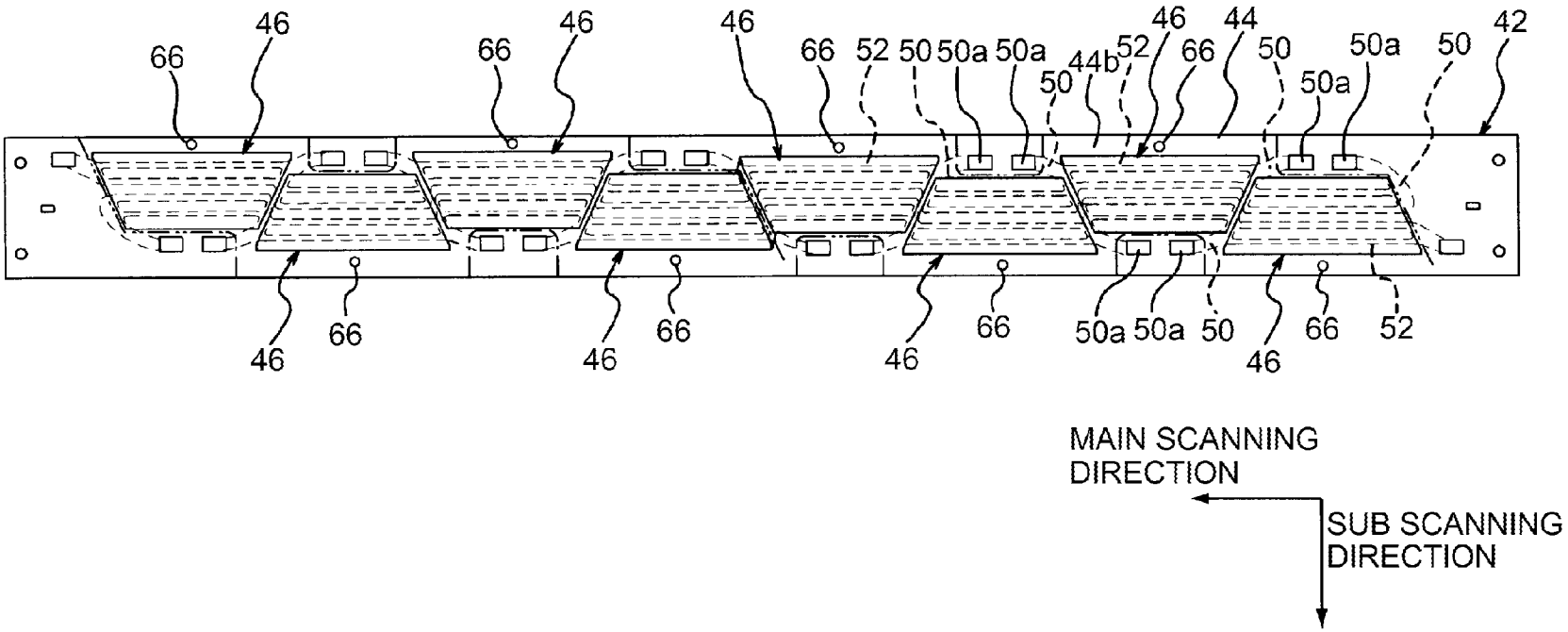
FIG. 2 is a plan view of an example ink ejection head of the inkjet printer.

As depicted in FIG. 1, each of the head units 14*a*-14*d* may comprise a head holder 40 having an approximately rectangular parallelepiped shape extending in the main scanning direction, and a liquid ejection head, e.g., an ink ejection head 42, disposed on a bottom surface of the head holder 40 to extend in the main scanning direction. In other words, the inkjet printer 10 may be a line printer. As depicted in FIGS. 2 and 3, the ink ejection head 42 may comprise a flow path unit 44 and a plurality of e.g., eight, piezoelectric element units 46 attached to an upper surface of the flow path unit 44. In this embodiment, one ink ejection head 42 may comprise a plurality of the piezoelectric element units 46.

Figure 3:
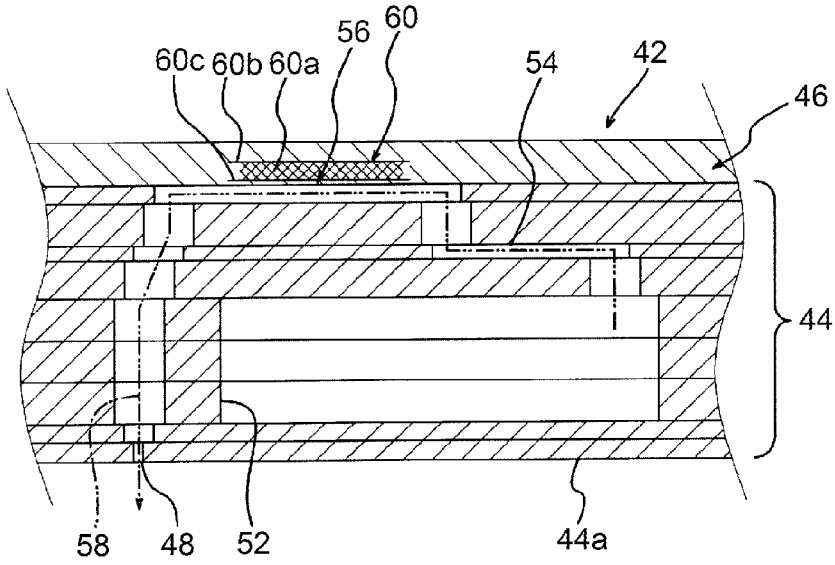
FIG. 3 is a partially enlarged cross-sectional view of the ink ejection head.

As depicted in FIG. 3, the flow path unit 44 may have a layered structure comprising a plurality of metal plates. A lower surface of the flow path unit 44 may be a nozzle surface 44*a* through which a plurality of the nozzles 48 are formed. The flow path unit 44 may include manifolds 50 (in FIG. 2), sub-manifolds 52 configured to communicate with the manifolds 50, and individual ink flow paths 58 extending from the sub-manifolds 52 to the nozzles 48 via apertures 54 and pressure chambers 56. As depicted in FIG. 2, an upper surface 44*b* of the flow path unit 44 may have a plurality of ink supply ports 50*a* configured to communicate with the manifolds 50. A reservoir (not depicted) configured to communicate with the ink supply ports 50*a* (in FIG. 2) may be disposed above the ink ejection head 42 inside the head holder 40, as depicted in FIG. 1. The reservoir may be connected to any of the ink tanks 16*a*-16*d*, via a tube and a pump (not depicted).

Figures 4A, 4B, 4C, 4D:
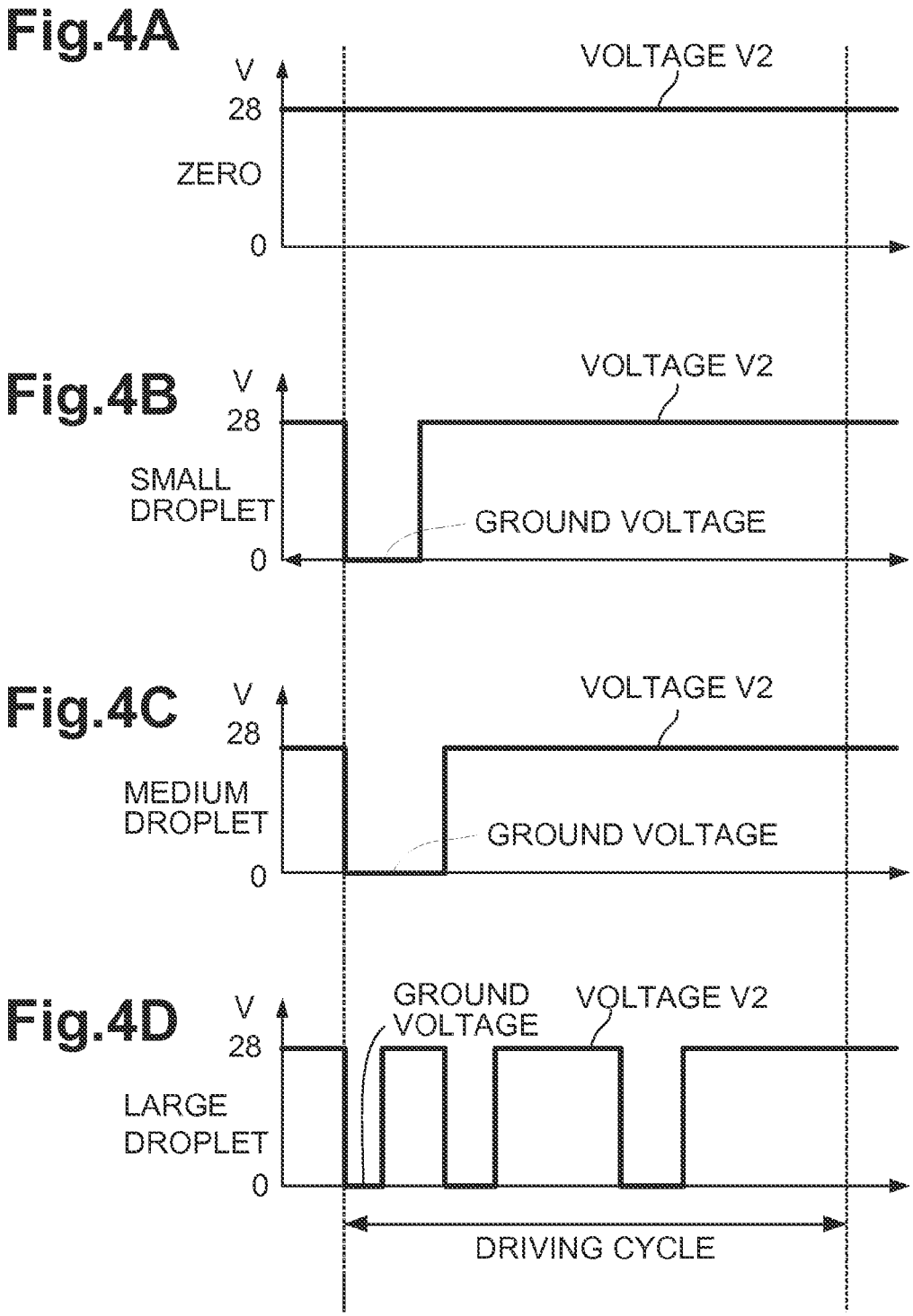
FIGS. 4A-4D are diagrams depicting example voltages applied to piezoelectric elements of the ink ejection head.

As depicted in FIG. 2, each of the piezoelectric element units 46 may have a trapezoidal shape in a plan view. Further, each of the piezoelectric elements 46 may be in a first position where its shorter edge is upstream in the sub scanning direction or in a second position where its longer edge is upstream in the sub scanning direction. Moreover, as shown in FIG. 2, the piezoelectric element units may alternate positions (between the first and second position) in the main scanning direction. As depicted in FIG. 3, each of the piezoelectric element units 46 may comprise a plurality of actuators 60 (as shown by grid lines in FIG. 3), and each of the plurality of actuators 60 may correspond to one of the pressure chambers 56. Each of the actuators 60 may comprise a piezoelectric element 60*a* and electrodes 60*b*, 60*c* disposed to sandwich the piezoelectric element 60*a*. A drive voltage V2 (e.g., 28 V) and a ground voltage (0 V), as depicted in FIG. 4, may be selectively applied to the electrodes 60*b*, 60*c*, based on a pulse voltage output from driver ICs 62 (in FIG. 5), to change amounts of ink ejected from the ink ejection head 42. The amount of ink ejected may be categorized into one of a plurality of levels. For example, the amount of ink ejected may be in one of four levels, referred to herein as a zero droplet amount level, a small droplet amount level, a medium droplet amount level, and a large droplet amount level.

As the drive voltage V2 (in FIG. 4) is applied to upper electrodes 60*b* depicted in FIG. 3, the piezoelectric elements 60*a* may contract in a direction perpendicular to their thickness in the vertical direction. Portions below the piezoelectric elements 60*a* may deform convexly toward the pressure chambers 56 to reduce the volumetric capacity of the pressure chambers 56. When the ground voltage (in FIG. 4) is applied to the upper electrode 60*b* of a piezoelectric element 60*a* that is deformed toward a pressure chamber 56, contraction of that piezoelectric element 60*a* may be released to return the volumetric capacity of the pressure chamber 56 to its original state, i.e., the volumetric capacity of the pressure chamber 56 may be increased. Therefore, as the ground voltage is applied instantaneously between the electrodes 60*b*, 60*c* while the voltage V2 is maintained, as depicted in FIG. 4, the volumetric capacity of the pressure chambers 56 may change at a time when the ground voltage is applied. Thus, ejection force may be applied to ink in the pressure chambers 56, and ink may be ejected from the nozzles 48.

Figure 5:
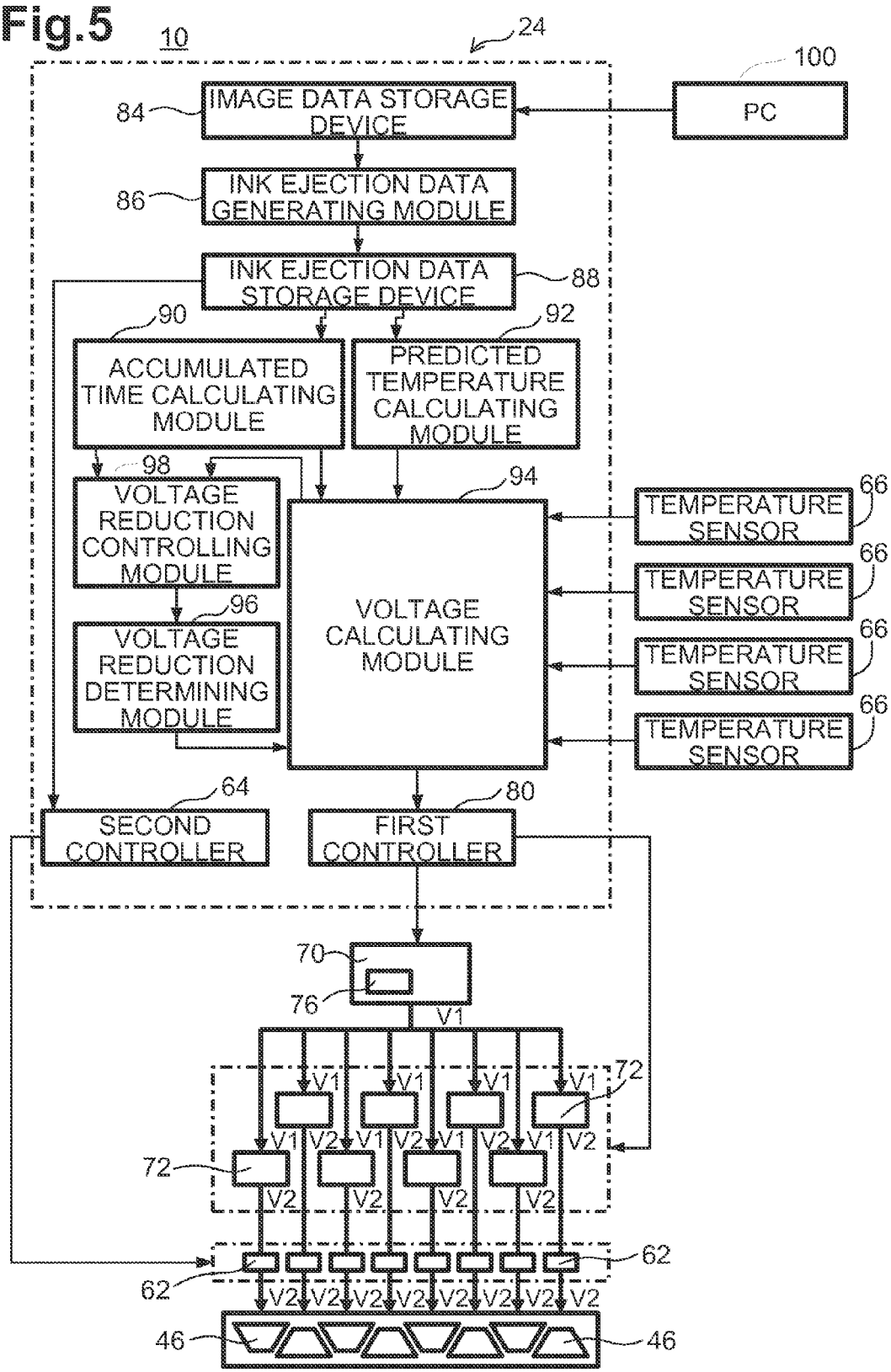
FIG. 5 is a block diagram depicting an example structure of the inkjet printer.

As depicted in FIG. 2, a temperature sensor 66 configured to sense the temperature of the ink ejection head 42 may be disposed at a portion adjacent to each piezoelectric element unit 46 (e.g., the upper surface 44*b* of the flow path unit 44 in this embodiment) or in a portion of the piezoelectric element unit 46 (e.g., in the pressure chamber 56). As depicted in FIG. 5, the temperature sensors 66 may be electrically connected to the controlling device 24. The controlling device 24 may determine the temperature of the piezoelectric element units 46, based on outputs of the temperature sensors 66. In some embodiments, the temperature sensor 66 might not be provided for each piezoelectric element unit 46. In other embodiments, one temperature sensor 66 may be provided for each of a plurality of the piezoelectric element units 46. In either case, the controlling device 24 may determine the temperature of each of the piezoelectric element units 46, based on, for example, distance from the temperature sensor 66.

As depicted in FIG. 5, the inkjet printer 10 may further comprise a power supply 70, a plurality of linear regulators 72 provided in correspondence with the respective piezoelectric element units 46, and a plurality of the driver ICs 62 provided in correspondence with the respective piezoelectric element units 46. A main voltage V1 output from the power supply 70 may be reduced to the drive voltage V2 corresponding to the piezoelectric element units 46 by the respective linear regulators 72. That is, each linear regulator 72 may reduce the main voltage V1 to produce a drive voltage V2 for a corresponding piezoelectric element unit 46. The driver ICs 62 may supply the drive voltages V2 to corresponding piezoelectric element units 46 according to one or more pulse voltage outputs (see FIGS. 4A-4D).

As depicted in FIG. 5, the power supply 70 may comprise a switching regulator 76 configured to output the predetermined main voltage V1. The switching regulator 76 may be configured to convert an input voltage by performing rapid switching, to obtain steady DC main voltage V1. In this embodiment, a DC/DC converter may be used. The type of the DC/DC converter may be, for example, a step-down converter or a step-up converter. The type of the switching regulator 76 might not be a type of DC/DC converter, and instead, may be a step-down switched capacitor or a step-up charge pump. As depicted in FIG. 5, the power supply 70 may be connected to a first controller 80 of the controlling device 24.

As depicted in FIG. 5, the linear regulators 72 may be configured to output the constant voltage V2 by reducing the main voltage V1 with resistance. In this embodiment, a three-terminal regulator may be used. The type of the linear regulator 72 might not be limited to the three-terminal regulator, and instead, may be, for example, a shunt regulator. As the main voltage V1 is supplied to an input terminal 72*a* of the linear regulator 72, the main voltage V1 may be reduced to the voltage V2 corresponding to the respective piezoelectric element units 46. The voltage V2 may be output from an output terminal 72*b* of the linear regulator 72.

As depicted in FIG. 5, each of the linear regulators 72 may be electrically connected to the first controller 80 of the controlling device 24. The first controller 80 may control a range or width that the linear regulators 72 reduce the main voltage V1 and ON/OFF operations of the linear regulators 72. In some embodiments, the main voltage V1 output from the power supply 70 may be supplied to the linear regulators 72 without being reduced or increased. The drive voltage V2 output from each linear regulator 72 may be supplied to the respective driver IC 62 without being reduced or increased.

Figure 6:
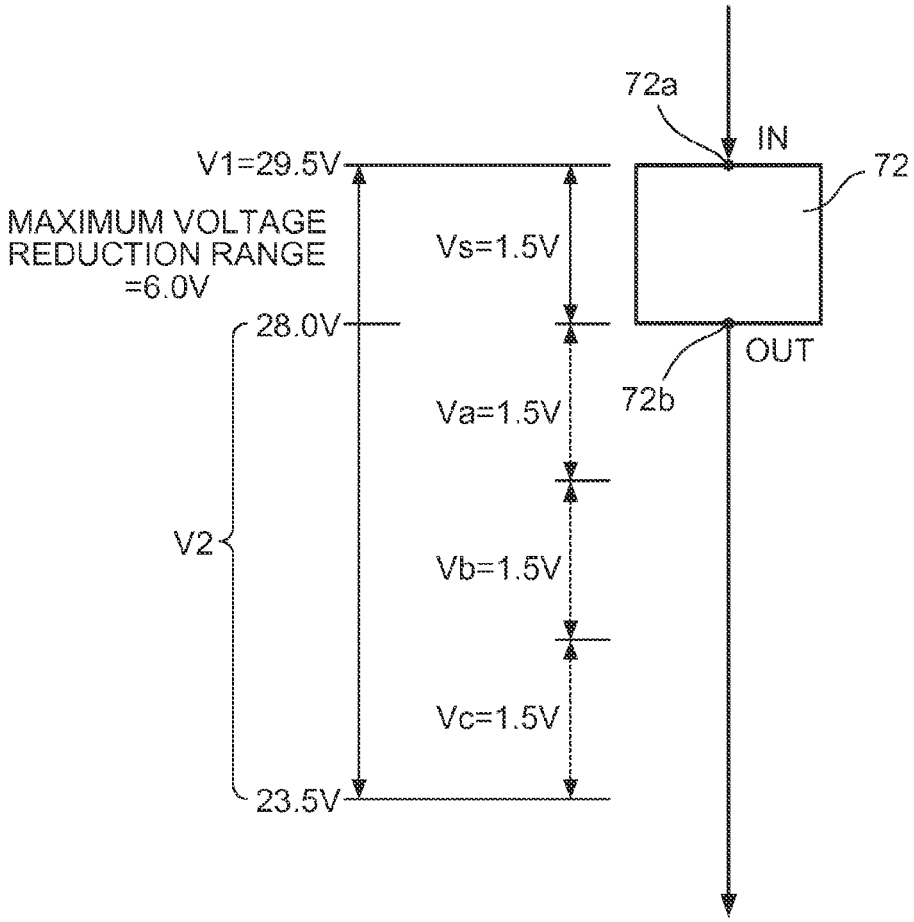
FIG. 6 is a block diagram depicting an example structure of a linear regulator of the inkjet printer.

As depicted in FIG. 6, the difference of voltage between the main voltage V1 and the drive voltage V2 (V1−V2) may be set to a predetermined fixed voltage Vs or greater (V1−V2≥Vs), to obtain an approximately steady drive voltage V2 for the linear regulators 72. In this embodiment, the fixed voltage Vs may be set to, for example, 1.5 V. The main voltage V1 may be set to such voltage (29.5 V) higher than the maximum value (e.g., 28 V) of the drive voltage V2 by the fixed voltage Vs (1.5 V).

The drive voltage V2 depicted in FIG. 6 may be the voltage applied to eject a predetermined droplet amount of ink from the nozzles 48. If the voltage V2 is fixed to a specific value, steady ejection of the predetermined droplet amount of ink may be difficult due to various factors. For example, when the voltage V2 is continuously applied to the piezoelectric elements 60*a* of the piezoelectric element units 46 without reducing the voltage V2, the piezoelectric elements 60*a* may deteriorate as the accumulated time of the voltage V2 application becomes longer. This may lead to reduction in an amount of ink ejected from the nozzles 48. When the temperatures of the piezoelectric element units 46 are raised due to usage of the printer 10 for a long period of time, the ink viscosity may be reduced and the amount of ink ejected may increase. As the temperatures of the piezoelectric element units 46 become higher, amounts of ink droplets ejected from the nozzles 48 may increase due to changes in the degree of deformation of the piezoelectric elements 60*a*. Further, each piezoelectric element unit 46 may have a deviation or difference attributable to manufacturing. Therefore, even when the same drive voltage V2 is applied to each of the piezoelectric element units 46, the same ink droplet amount might not be ejected from the nozzles 48. In this embodiment, the drive voltage V2 applied according to the piezoelectric element units 46 may be adjusted, based on i) the accumulated time in which the drive voltage V2 is applied, without being reduced, to the piezoelectric elements 60*a*, ii) the temperatures of the piezoelectric element units 46, and iii) individual differences among the piezoelectric element units 46.

In this embodiment, a first adjustment amount Va for the drive voltage V2 applied to the piezoelectric elements 60*a* of each of the piezoelectric element units 46 may be calculated based on the accumulated time of voltage application to each piezoelectric element unit 46. A second adjustment amount Vb for the drive voltage V2 applied to the piezoelectric elements 60*a* of each the piezoelectric element units 46 may be calculated based on the temperature of each piezoelectric element unit 46. A third adjustment amount Vc for the drive voltage V2 applied to the piezoelectric elements 60*a* of each piezoelectric element unit 46 may be calculated based on the deviation or difference between properties of the piezoelectric element units 46 (e.g., properties of the piezoelectric elements 60*a*). In this embodiment, the maximum voltage reduction range of the linear regulators 72 may be designed in consideration of maximum values of the adjustment amounts Va, Vb, Vc, as depicted in FIG. 6. For example, the maximum value of each adjustment amount Va, Vb, Vc may be 1.5 V bringing the total adjustment to 4.5 V. Accordingly, the maximum voltage reduction including the fixed voltage Vs may be set to 6 V.

For example, it may be assumed that the adjustment amounts Va, Vb, Vc for a certain piezoelectric element unit 46 are not zero (0) and the adjustment amounts Va, Vb, Vc for other piezoelectric element units 46 are zero (0). If the voltage difference (V1−V2) between the input terminal 72*a* and the output terminal 72*b* of the linear regulator 72 corresponding to the certain piezoelectric element unit 46 exceeds the maximum voltage reduction as a result of the voltage adjustment, a heating amount of the linear regulator 72 may increase, and a voltage supply circuit of the linear regulator 72 may be damaged. Therefore, reduction of the voltage applied to the piezoelectric elements 60*a* of the piezoelectric element unit 46 corresponding to the linear regulator 72 may be controlled not to exceed the maximum voltage reduction (e.g., the linear regulator 72 may be controlled to output voltages within a set range). In other words, the main voltage V1 applied to all linear regulators 72 may be the same. Therefore, if the differences between the linear regulators 72, with respect to the sum of the adjustment amounts (Va+Vb+Vc), exceed a maximum adjustment amount (the maximum voltage reduction range—the fixed voltage Vs), the voltage supply circuit of the linear regulators 72 may be damaged.

The driver ICs 62 depicted in FIG. 5 may be mounted on a flexible printed circuit board (not depicted) that may be connected to the piezoelectric element units 46. Each of the driver ICs 62 may be connected to the second controller 64 of the controlling device 24. The driver ICs 62 may generate pulse voltages, based on the voltage V2 supplied from the respective linear regulators 72 and print data supplied from the second controller 64. The pulse voltages may be applied to each piezoelectric element unit 46. The second controller 64 may control ON/OFF operations of the driver ICs 62.

The controlling device 24 depicted in FIG. 5 may be a computer including a central processing unit (CPU) (not depicted), a nonvolatile memory which may rewritably store programs to be executed by the CPU and various data, and memory (e.g., a random access memory (RAM)) which may temporarily store data when a program is executed. An ink ejection data generating module 86, an accumulated time calculating module 90, a voltage calculating module 94, a voltage reduction determining module 96, a voltage reduction controlling module 98, the first controller 80, and the second controller 64 may be realized as the controlling device 24 is operated based on the programs.

The image data storage device 84 may be configured to store image data of an image to be recorded on the recording medium P (in FIG. 1). The inkjet printer 10 may be connected to, for example, an external computer 100 that may generate image data and/or a reading apparatus (not depicted), such as a scanner, that may read image data from a storage medium. The image data may be transferred to the image data storage device 84 from, for example, the computer 100 and/or the reading apparatus. The image data may comprise density values of colors of respective pixels corresponding to a print area of the recording medium P.

The ink ejection data generating module 86 may be configured to generate ink ejection data, based on the image data stored in the image data storage device 84. The ink ejection data may comprise data representing a size of a dot (dot size) to be formed in a unit area (pixel area) virtually defined on the recording medium P. The dot size may be represented by one of a plurality of levels (or sizes), e.g., zero, a small droplet, a medium droplet, and a large droplet. The ink ejection data storage device 88 may be configured to store ink ejection data corresponding to each of the four ink ejection heads 42 (in FIG. 1).

The accumulated time calculating module 90 may be configured to calculate, based on ink ejection data stored in the ink ejection data storage device 88, the accumulated time that the drive voltage V2 is applied to the piezoelectric elements 60*a* of each piezoelectric element unit 46 without being reduced by the voltage calculating module 94. While the voltage calculating module 94 reduces the drive voltage V2, the accumulated time might not increase. In other words, additional time might not be added to the accumulated time when the voltage calculating module 94 reduces the drive voltage V2.

The voltage calculating module 94 may determine the first adjustment amount Va, the second adjustment amount Vb, and the third adjustment amount Vc. That is, the voltage calculating module 94 may calculate the first, second, and third adjustment amounts Va, Vb, Vc for the drive voltage V2 applied to the piezoelectric elements 60*a* of each piezoelectric element unit 46, based on the accumulated voltage application time of each piezoelectric element unit 46, based on the temperature of each piezoelectric element unit 46, and based on the deviations or differences among piezoelectric element units 46, respectively. The voltage calculating module 94 may be configured to adjust the drive voltage V2 depicted in FIG. 6, based on the first, second, and third adjustment amounts Va, Vb, Vc.

The voltage calculating module 94 may be configured to calculate a voltage lower than the drive voltage V2 to reduce the voltage applied to the piezoelectric element units 46 to a lower voltage than the drive voltage V2, when the voltage reduction determining module 96 determines that the voltage applied to the piezoelectric element units 46 should be reduced to a lower voltage than the drive voltage V2. The voltage calculating module 94 may reduce the voltage by a predetermined amount or to zero.

The voltage reduction determining module 96 may be configured to determine whether the voltage applied to the piezoelectric element units 46 that are not driven should be reduced to a voltage lower than the drive voltage V2.

The voltage reduction controlling module 98 may be configured to control the voltage reduction determining module 96. The voltage reduction controlling module 98 may be configured to control the voltage reduction determining module 96 to determine whether the drive voltage V2 is reduced. More specifically, a first piezoelectric element unit 46 may have the longest or maximum accumulated voltage application time (the maximum accumulated time T1) obtained by the accumulated time calculating module 90. A second piezoelectric element unit 46 may have the shortest or minimum accumulated voltage application time (the minimum accumulated time T2) obtained by the accumulated time calculating module 90. When the difference between the accumulated times of the first piezoelectric element unit 46 and the second piezoelectric element units 46 (T1−T2) is less than a predetermined time (Tx) (T1−T2<Tx), the voltage reduction controlling module 98 may control the voltage reduction determining module 96 to determine that the voltage applied to all of the non-driven piezoelectric element units 46 are allowed to be reduced to a voltage lower than the voltage V2. Thus, deterioration of all of the piezoelectric element units 46 that are not driven may be reduced.

When the difference between the accumulated times of the first piezoelectric element unit 46 and the second piezoelectric element unit 46 (T1−T2) is equal to or greater than the predetermined time (Tx) (T1−T2≥Tx), the voltage reduction controlling module 98 may control the voltage reduction determining module 96 to determine that the voltage applied to at least one (all or fewer than all) of the piezoelectric element units 46 that are not driven are allowed to be reduced to a voltage lower than the voltage V2. Thus, differences of deterioration among the piezoelectric element units 46 may be reduced or avoided. The voltage reduction controlling module 98 may be configured to control the voltage reduction determining module 96 when the difference between a maximum drive voltage V2max and a minimum drive voltage V2min among the drive voltages V2 after adjustment, i.e., the adjusted drive voltages, corresponding to each of the piezoelectric element units 46, exceeds a predetermined value α (V2max−V2min>α) (see step S3 in FIG. 7).

The second controller 64 may be configured to generate print data, based on the ink ejection data stored in the ink ejection data storage device 88, and to supply a voltage waveform based on the print data to the driver ICs 62. The second controller 64 may be configured to control ON/OFF operations of the driver ICs 62. The first controller 80 may be configured to control magnitude of the main voltage V1 output from the power supply 70 and ON/OFF operations of the power supply 70, the voltage reduction range of the linear regulators 72, and ON/OFF operations of the linear regulators 72.

Figure 7:
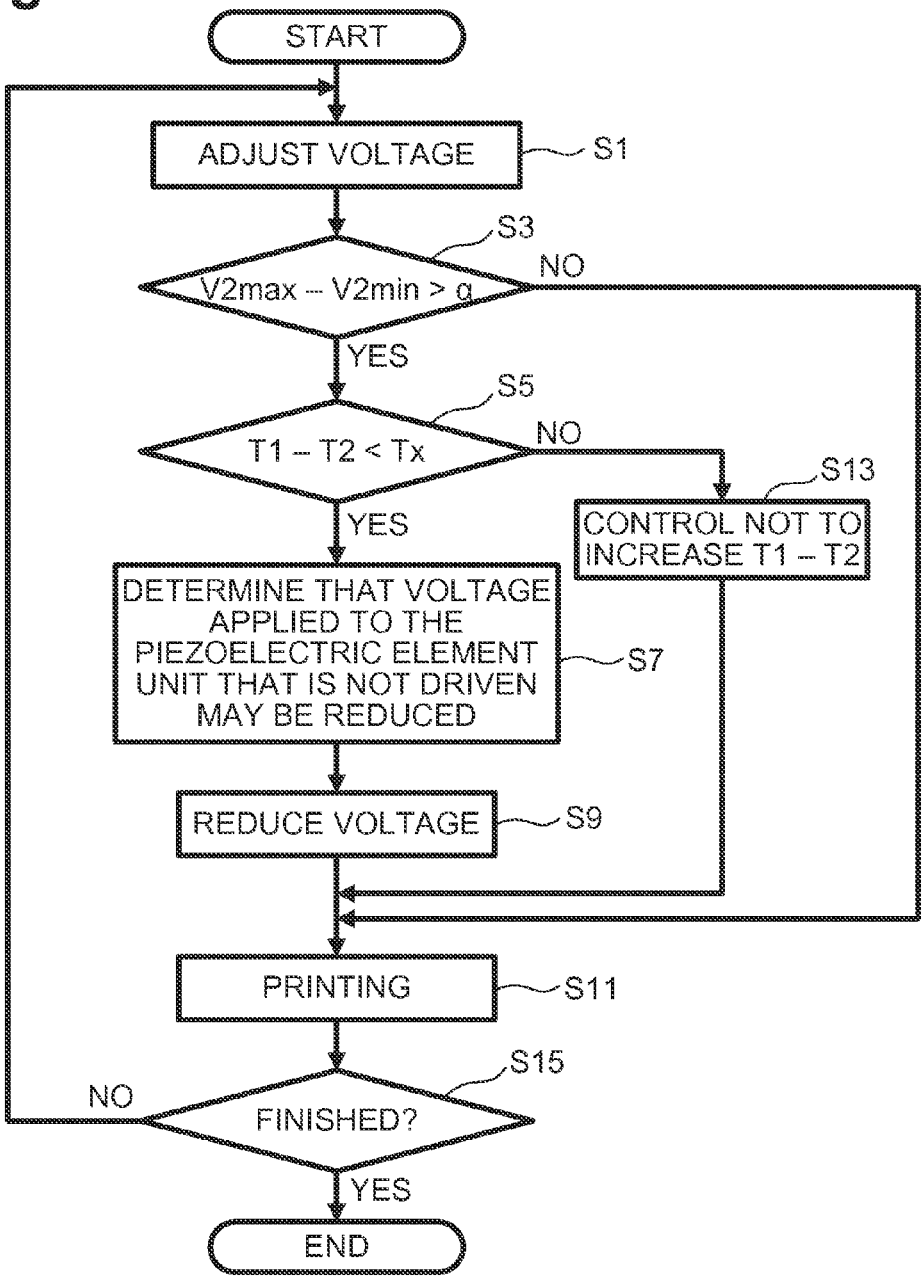
FIG. 7 is a flowchart depicting an example control process of the inkjet printer.

As depicted in FIG. 7, when the controlling device 24 (in FIG. 5) executes a control operation, the controlling device 24 may make adjustments for the drive voltage V2, based on the adjustment amounts Va, Vb, Vc (in FIG. 6) in step S1. The calculation of the first adjustment amount Va and the control of the voltage reduction determining module 96 may be performed at the same time when the second adjustment amount Vb is calculated. If a long period of time has elapsed from the time when the temperature of each piezoelectric element unit 46 is measured to the time when the drive voltage V2 is adjusted based on the measured temperatures and the voltage reduction determining module 96 is controlled, the temperatures of the piezoelectric element units 46 may be changed from those that have been measured. This may lead to an improper control. In this embodiment, when the second adjustment amount Vb is calculated based on the temperatures of each piezoelectric element unit 46, the calculation of the first adjustment amount Va and the control of the voltage reduction determining module 96 may be performed.

In step S3, the controlling device 24 may determine whether the difference between the maximum drive voltage V2max and the minimum drive voltage V2min (V2max−V2min) among the drive voltages V2 after adjustment, i.e., the adjusted voltages, corresponding each of the piezoelectric element units 46 exceeds the predetermined value α. When the controlling device 24 determines that the difference between the maximum drive voltage V2max and the minimum drive voltage V2min exceeds the predetermined value α (YES in step S3), the process may proceed to step S5. When the controlling device 24 determines that the difference between the maximum drive voltage V2max and the minimum drive voltage V2min does not exceed the predetermined value α (NO in step 3), the process may proceed to step S11. When the difference between the maximum drive voltage V2max and the minimum drive voltage V2min does not exceed the predetermined value α, the voltage reduction range may be relatively small, and deterioration of the piezoelectric element units 46 due to heating associated with the voltage reduction may be reduced or avoided. When the controlling device 24 determines that the difference between the maximum drive voltage V2max and the minimum drive voltage V2min does not exceed the predetermined value α (NO in step S3), a process to control the voltage reduction determining module 96 may be omitted. The predetermined value α may be set to, for example, a value (e.g., 1 V) lower than the maximum value of the adjustment amount Va, Vb, Vc.

In step S5, the controlling device 24 may determine whether the difference between the maximum accumulated voltage application time (maximum accumulated time T1) of the first piezoelectric element unit 46 and the minimum accumulated voltage application time (minimum accumulated time T2) of the second piezoelectric element unit 46 (T1−T2), among the accumulated voltage application times calculated by the accumulated time calculating module 90, is less than the predetermined time (Tx). When the controlling device 24 determines that the difference (T1−T2) is less than the predetermined time (Tx) (YES in step S5), the voltage reduction determining module 96 may determine that the voltage applied to the piezoelectric elements 60*a* of all of the piezoelectric element units 46 that are not driven are allowed to be reduced to a voltage lower than the drive voltage V2 in step S7. In step S9, the controlling device 24, more specifically, the voltage calculating module 94, may reduce the voltage to a lower voltage than the drive voltage V2. In step S11, a printing operation may be performed using the voltage adjusted in step S1 under the control of the controlling device 24.

As a method to reduce the voltage applied to the piezoelectric elements 60*a* of all of the piezoelectric element units 46 that are not driven from the voltage V2, a voltage lower than the voltage V2 calculated by the voltage calculating module 94 may be transmitted to the first controller 80. The first controller 80 may control an unloading circuit (not depicted), to discharge electric charge stored in the piezoelectric element unit 46 that is not driven (e.g., by connection to ground) in a state in which the first controller 80 turns off the power of the linear regulator 72 corresponding to the piezoelectric element unit 46 that is not driven. Another method may be employed to reduce electric charge stored in the piezoelectric element unit 46 that is not driven. Electric charge stored in the piezoelectric element unit 46 that is not driven may not have to be completely unloaded or removed but may be reduced.

When the controlling device 24 determines that the difference (T1−T2) is equal to or greater than the predetermined time (Tx) (NO in step S5), the process may proceed to step S13. At step S13, the piezoelectric element units 46 are controlled so that the difference (T1−T2) between the maximum accumulated time (T1) and the minimum accumulated time (T2) does not increase. For example, in step S13, the voltage reduction determining module 96 may determine that the voltage applied to at least one piezoelectric element unit 46 (e.g., all or fewer than all piezoelectric element units 46) among one or more of the non-driven piezoelectric element units 46 are allowed to be reduced to a voltage lower than the drive voltage V2, but not to increase the difference (T1−T2) between the maximum accumulated voltage application time (the maximum accumulated time T1 calculated by the accumulated time calculating module 90) of the first piezoelectric element unit 46 and the minimum accumulated voltage application time (the minimum accumulated time T2 calculated by the accumulated time calculating module 90) of the second piezoelectric element unit 46. Then, the process may proceed to step S11. In step S13, if the difference of the accumulated time between the first piezoelectric element unit 46 and the second piezoelectric element unit 46 (T1−T2) is increased by reducing the voltage applied to the piezoelectric elements 60*a* of at least one piezoelectric element unit 46 that is not driven to a voltage lower than the drive voltage V2, the controlling device 24 may control the difference of the accumulated time between the first piezoelectric element unit 46 and the second piezoelectric element unit 46 (T1−T2) not to increase, e.g., the voltage applied to the piezoelectric elements 60*a* of the second piezoelectric element unit 46 might not be reduced even if the second piezoelectric element unit 46 is not driven.

In step S13, in a case where the second piezoelectric element unit 46 having the minimum voltage application time (the minimum accumulated time T2) may be driven, and the first piezoelectric element unit 46 having the maximum voltage application time (the maximum accumulated time T1) might not be driven, the voltage reduction determining module 96 may determine that the voltage applied to the piezoelectric elements 60*a* of the first piezoelectric element unit 46 may be reduced to a voltage lower than the voltage V2. In a case where the second piezoelectric element unit 46 having the minimum accumulated time T2 is driven, and the first piezoelectric element unit 46 having the maximum accumulated time T1 is not driven, if the voltage applied to the piezoelectric elements 60*a* of the first piezoelectric element unit 46 is not reduced to a lower voltage than the drive voltage V2, the difference of the accumulated times (T1−T2) may not be reduced (e.g., the difference of the accumulated times (T1−T2) may be maintained). Therefore, in this case, the voltage applied to the piezoelectric elements 60*a* of the first piezoelectric element unit 46 may be reduced to a lower voltage than the drive voltage V2 to reduce the difference of the accumulated times (T1−T2).

In another embodiment, in a case where neither the first piezoelectric element units 46 nor second piezoelectric element units 46 may be driven, the voltage reduction determining module 96 may determine that the voltage applied to the piezoelectric elements 60*a* of each of the first piezoelectric element unit 46 and the second piezoelectric element unit 46 may be reduced to a lower voltage than the drive voltage V2. As the voltage applied to the piezoelectric elements 60*a* of each of the first piezoelectric element unit 46 and the second piezoelectric element unit 46 is reduced to a lower voltage than the voltage V2, the difference of the accumulated times (T1−T2) may be maintained (e.g., may not be increased).

In yet another embodiment, in a case where neither the first piezoelectric element units 46 nor second piezoelectric element units 46 may be driven, the voltage reduction determining module 96 may determine that the voltage applied to the piezoelectric elements 60*a* of the first piezoelectric element unit 46 may be reduced to a lower voltage than the drive voltage V2 and the voltage applied to the piezoelectric elements 60*a* of the second piezoelectric element unit 46 might not be reduced to a lower voltage than the drive voltage V2. If the voltage applied to the piezoelectric elements 60*a* of each of the first piezoelectric element unit 46 and the second piezoelectric element unit 46 is reduced to a lower voltage than the drive voltage V2 (similar to the another embodiment as described above), the difference of the accumulated times (T1−T2) might not be increased and might not be reduced. Therefore, the voltage applied to the piezoelectric elements 60*a* of the first piezoelectric element unit 46 may be reduced to a lower voltage than the voltage V2 and the voltage applied to the piezoelectric elements 60*a* of the second piezoelectric element unit 46 may not be reduced to a lower voltage than the voltage V2, to reduce difference of the accumulated times (T1−T2).

In still another embodiment, in a case where the first piezoelectric element unit 46 may be driven, and the second piezoelectric element unit 46 might not be driven, the voltage reduction determining module 96 may determine that the voltage applied to the piezoelectric elements 60*a* of the second piezoelectric element unit 46 might not be reduced to a lower voltage than the drive voltage V2. If the voltage applied to the piezoelectric elements 60*a* of the second piezoelectric element unit 46 is reduced to a lower voltage than the drive voltage V2, the difference of the accumulated times (T1−T2) may increase. Therefore, as the voltage applied to the piezoelectric elements 60*a* of the second piezoelectric element unit 46 is not reduced to a lower voltage than the voltage V2, the difference of the accumulated times (T1−T2) may be maintained and not increased. If there is or are additional piezoelectric element unit(s) 46 that is/are not driven other than the second piezoelectric element unit 46, the voltage reduction determining module 96 may determine that the voltage applied to the piezoelectric elements 60*a* of the additional piezoelectric element unit(s) 46 that is/are not driven may be reduced to a lower voltage than the drive voltage V2.

When the printing operation is finished in step S11, the controlling device 24 may determine whether the control operation is finished in step S15. When the controlling device 24 determines that the control operation is finished (YES in step S15), the process may end. When the controlling device 24 determines that the control operation is not finished (NO in step S15), the process may return to step S1.

The degree of deterioration of the piezoelectric element units 46 may become higher as the accumulated time of the drive voltage V2 applied, without being reduced, to the piezoelectric elements 60*a* becomes longer. In this embodiment, when the difference between the maximum accumulated voltage application time (maximum accumulated time T1) of the first piezoelectric element unit 46 and the minimum accumulated voltage application time (minimum accumulated time T2) of the second piezoelectric element unit 46 (T1−T2), among the piezoelectric element units 46 is less than the predetermined time (T1−T2<Tx), the voltage applied to the piezoelectric elements 60*a* of all of the piezoelectric element units 46 that are not driven may be reduced to a lower voltage than the drive voltage V2. Therefore, deterioration of all of the piezoelectric element units 46 that are not driven may be reduced. When the difference of the accumulated times (T1−T2) is equal to or greater than the predetermined time (T1−T2≥Tx), the voltage applied to the piezoelectric elements 60*a* of at least one of the piezoelectric elements units 46 among one or more of the piezoelectric element units 46 that are not driven, may be reduced to a lower voltage than the drive voltage V2, not to increase the difference (T1−T2) between the maximum accumulated voltage application time (the maximum accumulated time T1) of the first piezoelectric element unit 46 and the minimum accumulated voltage application time (the minimum accumulated time T2) of the second piezoelectric element unit 46. Therefore, difference in the degree of deterioration among the piezoelectric element units 46 may be reduced. When the adjusted voltage is applied according to the degrees of the deterioration of the piezoelectric element units 46, the differences of the ranges of the voltage reduction by the voltage calculating module 94 may be reduced among the piezoelectric element units 46. Accordingly, breakage of the voltage supply circuit may be reduced while the heating amounts of the linear regulators 72 may be controlled. The predetermined time Tx associated with the difference of the accumulated times (T1−T2) may correspond to the maximum value of the first adjustment amount Va (1.5 V in FIG. 6).

In this embodiment, the voltage applied to the piezoelectric elements 60*a* of each of the piezoelectric element units 46 may be adjusted based on the first adjustment amount Va relating to the accumulated voltage application time, the second adjustment amount Vb relating to the temperature of each piezoelectric element unit 46, and the third adjustment amount Vc relating to individual differences among the piezoelectric element units 46. Therefore, changes in amounts of ink droplets ejected from the nozzles 48 may be reduced. When the difference between the maximum voltage V2max and the minimum voltage V2min (V2max−V2min), among the adjusted voltage V2 corresponding to each of the piezoelectric element units 46, exceeds the predetermined value α, the controlling device 24, e.g., the voltage reduction controlling module 98, may control the voltage reduction determining module 96 (in step S3 in FIG. 7). Therefore, inefficient control may be reduced.

As described above, when the difference of the accumulated times (T1−T2) is less than the predetermined time (Tx) (T1−T2<Tx), the voltage applied to all of the piezoelectric element units 46 that are not driven may be reduced to a lower voltage than the drive voltage V2. In other embodiments, some piezoelectric element units 46 that are not driven might not receive a reduced voltage. That is, the voltage applied to a subset of the piezoelectric element units 46 that are not driven may be reduced to a lower voltage than the voltage V2.

As described above, in step S3 in FIG. 7, the controlling device 24 may determine whether the difference between the maximum voltage V2max and the minimum voltage V2min (V2max−V2min) among the adjusted voltage V2 corresponding to each of the piezoelectric element units 46 exceeds the predetermined value α. In another embodiment, the controlling device 24 may determine whether difference between a maximum voltage Vamax and a minimum voltage Vamin (Vamax−Vamin) among the first adjustment amount Va corresponding to each of the piezoelectric element units 46 exceeds a predetermined value γ. The predetermined value γ may be a value, e.g., 1 V, smaller than the maximum value of the first adjustment amount Va.

In the above embodiment, as a method to reduce the voltage applied to the piezoelectric elements 60*a* of the piezoelectric element unit 46 that is not driven, to a lower voltage than the drive voltage V2, electric charges stored in the piezoelectric element unit 46 that is not driven may be discharged (e.g., by connection to ground), in a state in which the first controller 80 turns off the power of the linear regulator 72 corresponding to the piezoelectric element unit 46 that is not driven. In another embodiment, the voltage applied to the piezoelectric elements 60*a* of the piezoelectric element unit 46 that is not driven may be reduced using an unloading circuit in a state in which the first controller 80 turns off the power at a portion other than the linear regulator 72 corresponding to the piezoelectric element unit 46 that is not driven. With the unloading circuit, the voltage applied to the piezoelectric elements 60*a* of the piezoelectric element unit 46 that is not driven may be reduced to a lower voltage than the drive voltage V2 by discharging electric charges stored in the piezoelectric element unit 46.

In the above-described embodiments, the controlling device 24 may comprise one or more CPUs, one or more application specific integrated circuits ("ASICs"), or a combination of one or more CPUs and one or more ASICs. For example, the modules and/or controllers of the controlling device 24 may be implemented with ASICs.

Figure 8:
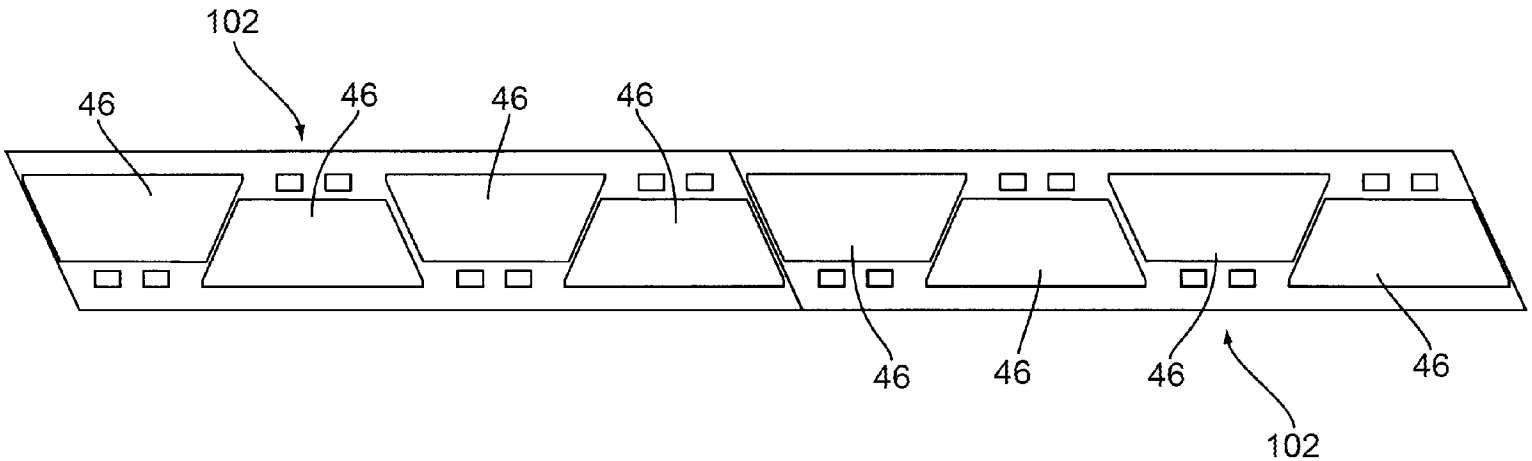
FIG. 8 is a partially enlarged cross-sectional view of the ink ejection head in another example embodiment according to one or more aspects of the disclosure.

As depicted in FIG. 2, a plurality of the piezoelectric element units 46 may be included in one ink ejection head 42. In another embodiment, as depicted in FIG. 8, one or more of the piezoelectric element units 46 may be included in each of a plurality of liquid ejection heads 102 that are aligned in the main scanning direction. As shown in FIG. 8, the inkjet printer 10 may comprise, for example, two liquid ejection heads 102 for each color of ink, where each liquid ejection head 102 may comprise, for example, four piezoelectric element units 46.

The disclosure may be applied not only to the inkjet printer 10 configured to eject ink as depicted in FIG. 1, but also to a liquid ejection apparatus configured to eject liquid other than ink.

While the disclosure has been described in detail with reference to specific embodiments thereof, these are merely examples, and various changes, arrangements and modifications may be applied therein without departing from the spirit and scope of the disclosure.

What is claimed is:

1. A liquid ejection apparatus comprising:

a plurality of piezoelectric element units comprising piezoelectric elements, the piezoelectric element units configured to be driven to eject liquid by changing a drive voltage;

a power supply configured to output a predetermined main voltage;

a plurality of linear regulators provided in correspondence with the piezoelectric element units, the linear regulators configured to supply drive voltages to the respective piezoelectric element units by reducing the main voltage output from the power supply; and a control device configured to:

calculate an accumulated time, for each of the piezoelectric element units, that the respective piezoelectric element unit is in a driven state, wherein a piezoelectric element unit is in the driven state when the corresponding drive voltage is not reduced or when liquid is ejected;

identify a first piezoelectric element unit having a maximum accumulated time and a second piezoelectric element unit having a minimum accumulated time from among the plurality of piezoelectric element units;

determine whether a difference between the maximum accumulated time and the minimum accumulated time is less than a predetermined time; and reduce the drive voltage applied to one or more of the piezoelectric element units that are not in the driven state to a lower voltage, when the control device determines that the difference is less than the predetermined time.

2. The liquid ejection apparatus according to claim 1, wherein the control device is configured to reduce the drive voltages applied to all of one or more of the piezoelectric element units that are not in the driven state to a lower voltage, when the control device determines that the difference is less than the predetermined time.

3. The liquid ejection apparatus according to claim 1, wherein the control device is configured to reduce the drive voltage applied to the first piezoelectric element unit that is not in the driven state to a lower voltage, when the control device determines that the difference is greater than or equal to the predetermined time.

4. The liquid ejection apparatus according to claim 1, wherein the control device is configured to:

reduce the drive voltage applied to the first piezoelectric element unit that is not in the driven state to a lower voltage, when the control device determines that the difference is greater than or equal to the predetermined time; and reduce the drive voltage applied to the second piezoelectric element unit that is not in the driven state to a lower voltage.

5. The liquid ejection apparatus according to claim 1, wherein the control device is configured to:

maintain the drive voltage applied to the second piezoelectric element unit that is in the driven state, when the control device determines that the difference is greater than or equal to the predetermined time; and maintain the drive voltage applied to the first piezoelectric element unit that is in the driven state.

6. The liquid ejection apparatus according to claim 1, wherein the control device is configured to adjust the drive voltage applied to each of the plurality of piezoelectric element units based on the corresponding accumulated time.

7. The liquid ejection apparatus according to claim 1, wherein the control device is configured to:

calculate a first adjustment amount of each drive voltage applied to the plurality of piezoelectric element units based on the corresponding accumulated time, calculate a second adjustment amount of each drive voltage applied to the plurality of piezoelectric element units based on a temperature, and adjust the drive voltages applied to the plurality of piezoelectric element units based on the corresponding first adjustment amount and the corresponding second adjustment amount.

8. The liquid ejection apparatus according to claim 1, further comprising one liquid ejection head comprising the piezoelectric element units.

9. The liquid ejection apparatus according to claim 1, further comprising a plurality of liquid ejection heads, each comprising one or more of the piezoelectric element units.

10. A method of a liquid ejecting apparatus comprising a plurality of piezoelectric element units, the piezoelectric element units configured to be driven to eject liquid by changing a respective drive voltage, the method comprising steps of:

calculating an accumulated time, for each of the piezoelectric element units, that the respective piezoelectric element unit is in a driven state, wherein a piezoelectric element unit is in the driven state when the corresponding drive voltage is not reduced or when liquid is ejected;

identifying a first piezoelectric element unit having a maximum accumulated time and a second piezoelectric element unit having a minimum accumulated time from among the plurality of piezoelectric element units;

determining whether a difference between the maximum accumulated time and the minimum accumulated time is less than a predetermined time; and reducing the drive voltage applied to one or more of the piezoelectric element units that are not in the driven state to a lower voltage, when a control device determines that the difference is less than the predetermined time.

11. One or more non-transitory, computer-readable media storing computer-readable instructions therein that, when executed by at least one processor of a liquid ejecting apparatus comprising a plurality of piezoelectric element units configured to be driven to eject liquid by changing a respective drive voltage, cause the liquid ejecting apparatus to:

calculate an accumulated time, for each of the piezoelectric element units, that the respective piezoelectric element unit is in a driven state, wherein a piezoelectric element unit is in the driven state when the corresponding drive voltage is not reduced or when liquid is ejected;

identify a first piezoelectric element unit having a maximum accumulated time and a second piezoelectric element unit having a minimum accumulated time from among the plurality of piezoelectric element units;

determine whether a difference between the maximum accumulated time and the minimum accumulated time is less than a predetermined time; and reduce the drive voltage applied to one or more of the piezoelectric element units that are not in the driven state to a lower voltage, when a control device determines that the difference is less than the predetermined time.

* * * * *